US008468959B2

(12) United States Patent
Sturgeon

(10) Patent No.: US 8,468,959 B2
(45) Date of Patent: Jun. 25, 2013

(54) BASKET WEAVE TRESTLE TABLE

(76) Inventor: James M. Sturgeon, Charleston, WV (US)

( * ) Notice: Subject to any disclaimer, the term of this patent is extended or adjusted under 35 U.S.C. 154(b) by 267 days.

(21) Appl. No.: 12/694,841

(22) Filed: Jan. 27, 2010

(65) Prior Publication Data

US 2011/0179980 A1 Jul. 28, 2011

(51) Int. Cl.
*A47B 13/00* (2006.01)

(52) U.S. Cl.
USPC ..... 108/158.12; 108/153.1; 248/188.91

(58) Field of Classification Search
USPC ..... 108/180, 186, 190, 192, 193, 129, 108/132, 153.1, 158.12, 158.13, 157.18, 108/154; 211/182; 248/188.1, 188.91, 163.1
See application file for complete search history.

(56) References Cited

U.S. PATENT DOCUMENTS

| | | | | | |
|---|---|---|---|---|---|
| 901,152 | A | * | 10/1908 | Churchill | 108/158 |
| 2,077,770 | A | * | 4/1937 | Provisor | 248/188.91 |
| 2,962,170 | A | * | 11/1960 | Best | 211/182 |
| 3,747,885 | A | * | 7/1973 | Ciancimino | 248/188.1 |
| D232,610 | S | * | 9/1974 | Peterson | D6/479 |
| D242,681 | S | * | 12/1976 | Thomas | D6/485 |
| 4,094,417 | A | * | 6/1978 | Cairnes et al. | 211/182 |
| 4,126,289 | A | * | 11/1978 | Uhlig | 248/188.1 |
| 4,239,280 | A | | 12/1980 | Ackerman | |
| 4,322,109 | A | | 3/1982 | Thebaud | |
| D271,923 | S | * | 12/1983 | Thompson | D6/485 |
| 4,904,022 | A | * | 2/1990 | Morozzi | 248/188.91 |
| 4,998,697 | A | * | 3/1991 | Esposito | 108/158.12 |
| 5,067,589 | A | | 11/1991 | Bartnicki | |
| 5,318,260 | A | * | 6/1994 | Kemnitz | 248/188.91 |
| 5,435,510 | A | * | 7/1995 | Wey | 248/188.1 |
| 5,499,585 | A | | 3/1996 | Vanderminden, Sr. | |
| D413,460 | S | | 9/1999 | Schroeder | |
| D475,869 | S | | 6/2003 | Jackson | |
| D553,394 | S | | 10/2007 | Geraghty | |
| D647,331 | S | * | 10/2011 | Sturgeon | D6/480 |

* cited by examiner

*Primary Examiner* — Jose V Chen
(74) *Attorney, Agent, or Firm* — Cahn & Samuels, LLP

(57) ABSTRACT

An embodiment of the invention provides a support trestle comprising at least a first, second, and third generally vertically disposed support elements. A first set of stretchers is connected to at least two of the first, second, and third generally vertically disposed support elements, wherein the first set of stretchers include a top first stretcher, at least one middle first stretcher, and a bottom first stretcher. A second set of stretchers is connected to at least two of the first, second, and third generally vertically disposed support elements, wherein the second set of stretchers include a top second stretcher, at least one middle second stretcher, and a bottom second stretcher. The generally vertically disposed support elements that are connected to the second set of stretchers are different from the generally vertically disposed support elements that are connected to the first set of stretchers.

20 Claims, 6 Drawing Sheets

BASKET WEAVE TRESTLE TABLE

I. DESCRIPTION OF THE TECHNICAL FIELD

This invention relates to an improvement in support structures and more particularly to a trestle table having an interlaced basket weave support structure.

II. BACKGROUND OF THE INVENTION

The trestle table is one of the oldest furniture designs. Examples of the trestle table were common in ancient Rome. The basic design consists of two pairs of vertical supports that are typically attached to the under side of the tabletop. A horizontal bar/stretcher maintains alignment of the vertical supports. Advantages of the trestle table over a conventional table with corner and perimeter legs include enhanced leg room, reduced interference with chair placement, and minimized impact and damage, such as that occurring from chair and leg collisions during normal use.

A known fundamental weakness of the conventional trestle table is attributed to its stretcher design. Small movement of the stretcher connection allows end-to-end rocking of the table, which often contributes to additional enlargement of the gap in the stretcher connection resulting in further instability. Conventionally, the position of the stretcher is fixed by hammering wedges or shims at the end of the stretcher where it intersects with the support legs. Another disadvantage of the trestle table design is the need to use the table top as a stabilizer of the overall structure. The stabilizing functionality thereby limits the flexibility of top design.

III. SUMMARY OF THE INVENTION

The invention relates to a trestle support having a novel structure.

It is an object of the invention to provide a structure providing a rigid, stable base for supporting various articles.

It is another object of the invention to provide a modular support structure that can utilize the same leg support system with table tops of varying shapes and sizes.

It is yet another object of the invention to provide a structure having an interlaced basket weave form.

It is still another object of the invention to provide a structure having slidable support members that facilitate ease of assembly and disassembly.

It is still yet another object of the invention to provide a collapsible structure that facilitates ease of storage and transportation.

It is a further object of the invention to provide a unique configuration of stretchers that form an aesthetically pleasing design.

Certain of these and other objects are satisfied by a trestle element having at least a first, second, and third generally vertically disposed support elements, where first set of stretchers of a first length and having a first and second ends are connected to at least two of the first, second, and third generally vertically disposed support elements, and second set of stretchers of a second length having a first and second ends are also connected to at least two of the first, second, and third generally vertically disposed support elements. The generally vertically disposed support elements that are connected to the second set of stretchers are different from the generally vertically disposed support elements that are connected to the first set of stretchers. The first set of stretchers criss-cross the second set of stretchers at a point along a length of the second set of stretchers between the first and second ends thereof.

The first and second sets of stretchers are generally horizontally disposed relative to the first, second, and third generally vertically disposed support elements. In at least one embodiment of the invention, the first set of stretchers have a length equal to the length of the second set of stretchers.

The first and second sets of stretchers each include a top stretcher, at least one middle stretcher, and a bottom stretcher. More specifically, the bottom second stretcher is above the bottom first stretcher; the at least one middle first stretcher is above the bottom second stretcher; the at least one middle second stretcher is above the at least one middle first stretcher; the top first stretcher is above the at least one middle second stretcher, and the top second stretcher is above the top first stretcher.

At least one second stretcher of the second set of stretchers is positioned between each overlying pair of first stretchers of the first set of stretchers. Similarly, at least one first stretcher of the first set of stretchers is positioned between each overlying pair of second stretchers of the second set of stretchers.

The first set of stretchers include at least one upper first stretcher and at least one lower first stretcher, wherein at least one second stretcher of the second set of stretchers is positioned between each upper first stretcher and each lower first stretcher.

Other objects are satisfied by a planar surface contacting top portions of the first, second, and third generally vertically disposed support elements.

Still other objects are satisfied by a support rod disposed through the first and second set of stretchers at the point along the length of the second set of stretchers (i.e., the point of criss-cross).

Yet other objects are satisfied by first mating elements disposed on opposite ends of the first and second set of stretchers.

Still yet other objects are satisfied by complementary second mating elements on the first, second, and third generally vertically disposed support elements for receiving the first mating elements therein.

In at least one embodiment of the invention, the first mating elements have a rounded configuration; and, the second mating elements include a channel having a circular cross-section.

For definitional purposes and as applicable, the term "table top" as used herein is intended to mean surface (planar or non-planar), platform, counter, board, and the like which overlies a set of legs.

As used herein, the term "legs" is intended to mean generally vertically disposed support elements, vertical members, props, buttresses, and the like.

As used herein, "stretchers" is intended to mean generally horizontal crosspieces, horizontal members, stringers, planks, beams, laths, struts, joists, bars, and the like.

As used herein, "rod" is intended to mean shaft (threaded or non-threaded), dowel, pole, baton, stake, bolt, and the like.

As used herein, "channel" is intended to mean slot, slit, groove, conduit, bore, notch, and the like.

The term "criss-cross" as used herein is intended to mean cross-over, overlap, overlay, intersect, interlace, and the like.

The term "rounded" as used herein is intended to mean ball, spherical, cylindrical shape, and the like. As used herein "connected" includes physical, whether direct or indirect, permanently affixed or adjustably mounted. Thus, unless specified, "connected" is intended to embrace any operationally functional connection.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWING

V. DETAILED DESCRIPTION OF THE EMBODIMENTS

Referring now to the figures, wherein like reference numbers denote like components, elements, or features through the various illustrated embodiments discussed in detail below, the invention is a trestle table having an interlaced basket weave support structure. While specific implementations of the disclosed technology are discussed, it should be understood that this is done for illustration purposes only. A person skilled in the relevant art will recognize that other components and configurations may be used without departing from the spirit and scope of the invention.

As illustrated in FIGS. 1-5, an embodiment of the invention provides a basket weave trestle table 100 having a table top 110 and two closely spaced legs per end. The legs 120, 122, 124, and 126 are each slotted from top to bottom in order to accept stretchers 130 and 132 therewithin. The stretchers 130 and 132 alternate in a basket weave configuration between the two ends of the table 100 in a diagonal pattern.

Figure 1:
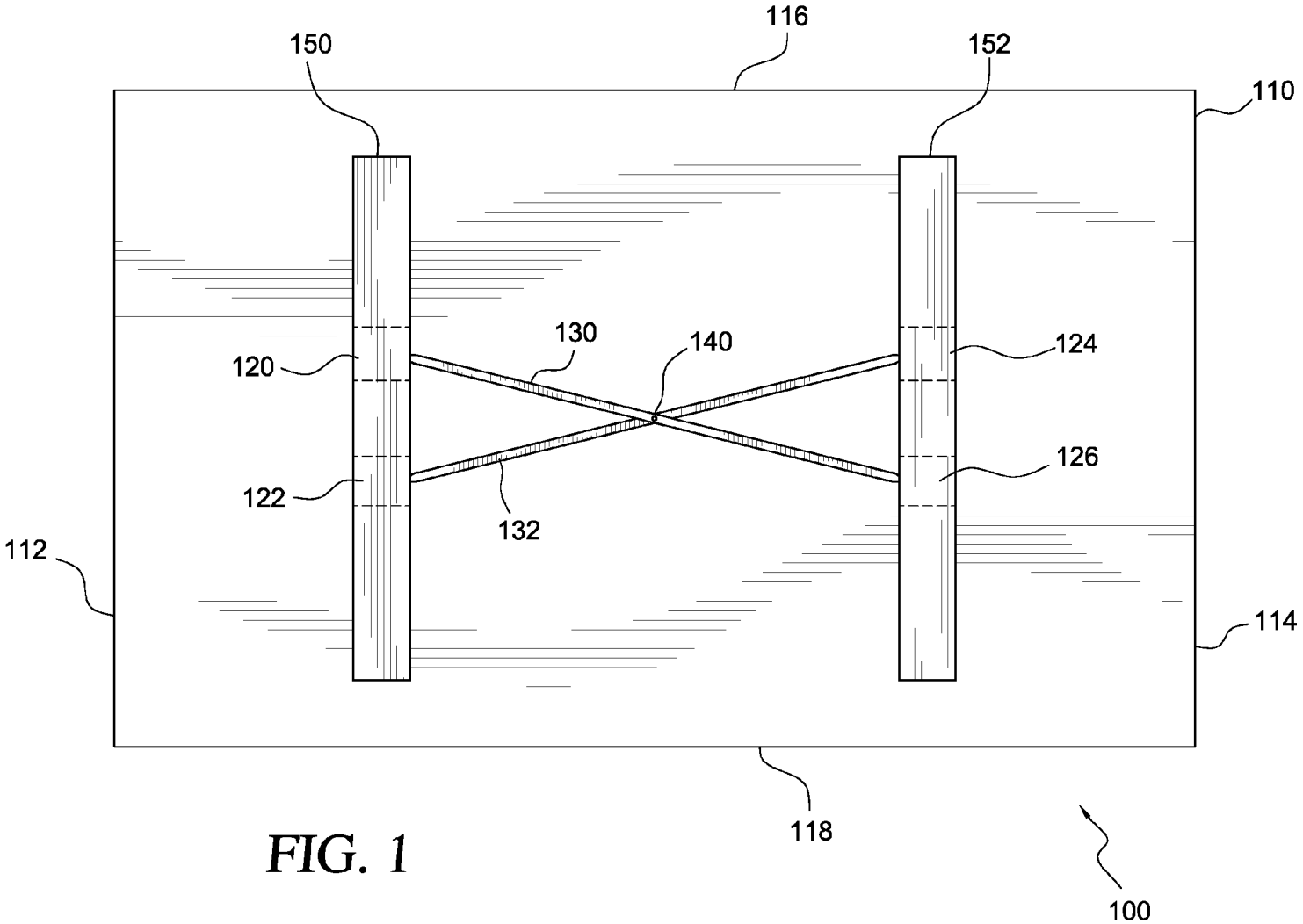
FIG. 1 is a bottom view of a trestle table according to an embodiment of the invention.

FIG. 1 illustrates a bottom view of the table 100 according to an embodiment of the invention. As described more fully below, the structure of the table 100 consists of criss-crossing stretchers 130 and 132, which form two triangles A and B connected at a common angle when viewed from the bottom. A triangle is structurally the strongest geometric form. The stretchers 130 and 132 include an aperture at the point of criss-cross, wherein a rod 140 is inserted into the aperture to hold the stretchers 130 and 132 together and create the triangle strength.

In the embodiment illustrated in FIG. 1, the rod 140 is inserted into the stretchers 130 and 132 at their center points, such that the stretchers 130 criss-cross the stretchers 132 at an angle of approximately 45 degrees. In another embodiment, the rod 140 is not inserted into the stretchers 130 and 132 at their center points, wherein different angles are formed between the stretchers 130 and 132. In yet another embodiment, the length of the stretchers 130 are different than the length of the stretchers 132. For example, in at least one embodiment, the point of criss-cross between the stretchers 130 and 132 is closer to one end of the table 100 relative to the other ends of the table 100. In another example, the point of criss-cross between the stretchers 130 and 132 is closer to one corner of the table 100 relative to the other corners of the table 100.

In at least one embodiment of the invention, the table top 110 includes a first end 112, a second end 114, a third end 116, and a fourth end 118. Specifically, the first end 112 is opposite the second end 114; and, the third end 116 is opposite the fourth end 118. In another embodiment, the table top 110 is triangular and only includes three ends. In yet another embodiment, the table top 110 includes more than four ends. For example, in the embodiment illustrated in FIG. 5, a table top 510 has eight ends 511-518.

In the embodiment illustrated in FIG. 1, the first leg 120 and second leg 122 are proximate the first end 112 of the table top 110; and, the third leg 124 and fourth leg 126 are proximate the second end 114 of the table top 110. The first leg 120 and the third leg 124 are proximate the third end 116 of the table top 110; and, the second leg 122 and the fourth leg 126 are proximate the fourth end 118 of the table top 110.

In the embodiment illustrated in FIG. 1, the legs 120-126 are linear and have a generally vertical orientation. In another embodiment, however, the legs 120-126 are non-linear (i.e., includes curves, bows, and/or twists) and/or are slanted relative to the table top 110. In yet another embodiment, the table 100 includes less than four legs. For example, in at least one embodiment, the table 100 includes two wide legs for supporting two or more sets of stretchers. In still another embodiment, the table 100 includes more than four legs. For example, in one embodiment, the table 100 includes fifth and sixth legs for supporting a third and fourth set of stretchers.

In the embodiment illustrated in FIG. 1, the stretchers 130 and 132 are linear and have a generally horizontal orientation. Moreover, the stretchers in the set of stretchers 130 (also referred to herein as "first stretchers") are equal in length; and, the stretchers in the set of stretchers 132 (also referred to herein as "second stretchers") are equal in length. In another embodiment, however, the stretchers 130 and 132 are non-linear (i.e., includes curves, bows, and/or twists) and/or are slanted relative to the table top 110. In yet another embodiment, the set of stretchers 130 include first stretchers of varying length; and, the set of stretchers 132 include second stretchers of varying length.

In at least one embodiment, the table 100 includes a leg support 150 connected to bottoms of the first leg 120 and second leg 122, and a leg support 152 connected to bottoms of the third leg 124 and fourth leg 126. In another embodiment, the leg support 150 is connected to the bottoms of the first leg 120 and third leg 124; and, the leg support 152 is connected to the bottoms of the second leg 122 and fourth leg 126. In yet another embodiment, the table 100 lacks leg supports 150 and 152.

Figure 2:
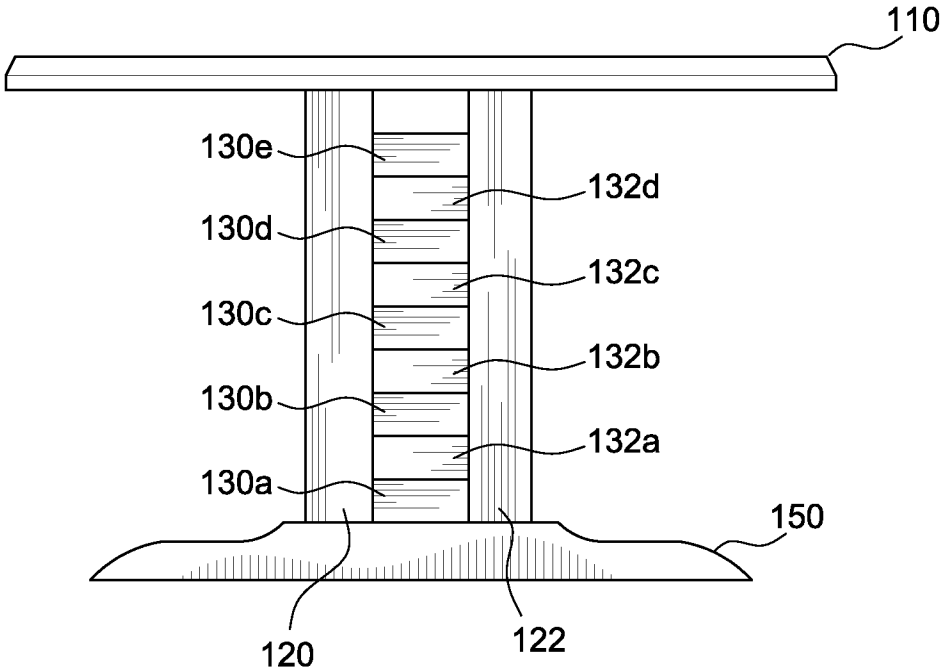
FIG. 2 is a side view of a trestle table according to an embodiment of the invention.

FIG. 2 illustrates a side view of the table 100 showing the interlacing of the basket weave stretchers 130*a*-130*e* and 132*a*-132*d* according to an embodiment of the invention. The stretchers 130 include at least one upper first stretcher (e.g., stretcher 130*e*) and at least one lower first stretcher (e.g., stretcher 130*d*), wherein at least one second stretcher (e.g., stretcher 132*d*) is positioned between each upper first stretcher and each lower first stretcher.

Figure 3:
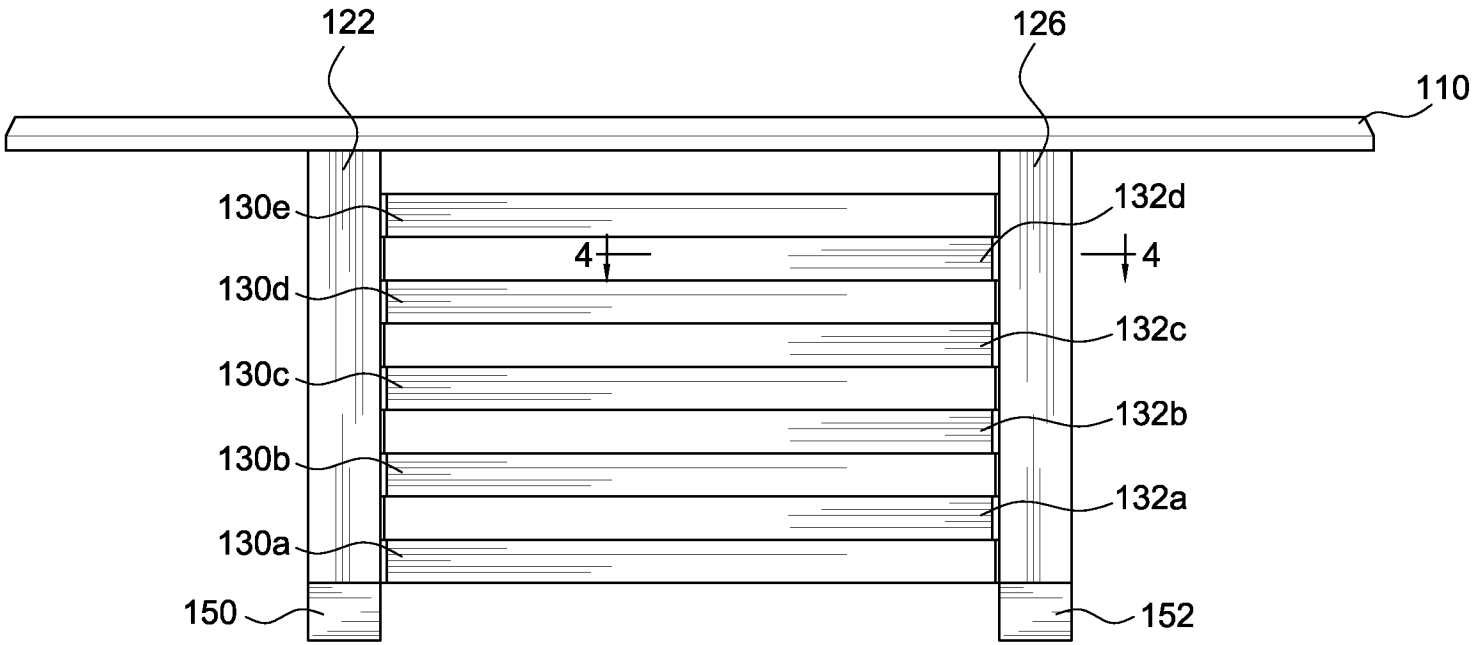
FIG. 3 is a front view of a trestle table according to an embodiment of the invention.

FIG. 3 illustrates a front view of the table 100 showing the alternating stretchers 130, 132 and the location of the rod 140 according to an embodiment of the invention. At least one first stretcher (e.g., stretcher 130*b*) is positioned between each overlying pair of second stretchers (e.g., stretcher 132*a* and 132*b*); and, at least one second stretcher (e.g., stretcher 132*c*) is positioned between each overlying pair of first stretchers (e.g., stretchers 130*c* and 130*d*).

In at least one embodiment of the invention, each leg 120-126 includes a channel into which the stretchers 130 and 132 are attached, for example, with glue and/or other wood fasteners. This creates the strongest structural base. The stretchers 130 and 132 each include first mating elements disposed on opposite ends thereof. The legs 120-126 each include a complementary second mating element for engaging the first mating elements. In at least one embodiment, the first mating elements have a rounded configuration; and, the second mating element is a channel (linear or non-linear) having a circular cross-section for receiving the first mating elements therein.

Figure 4:
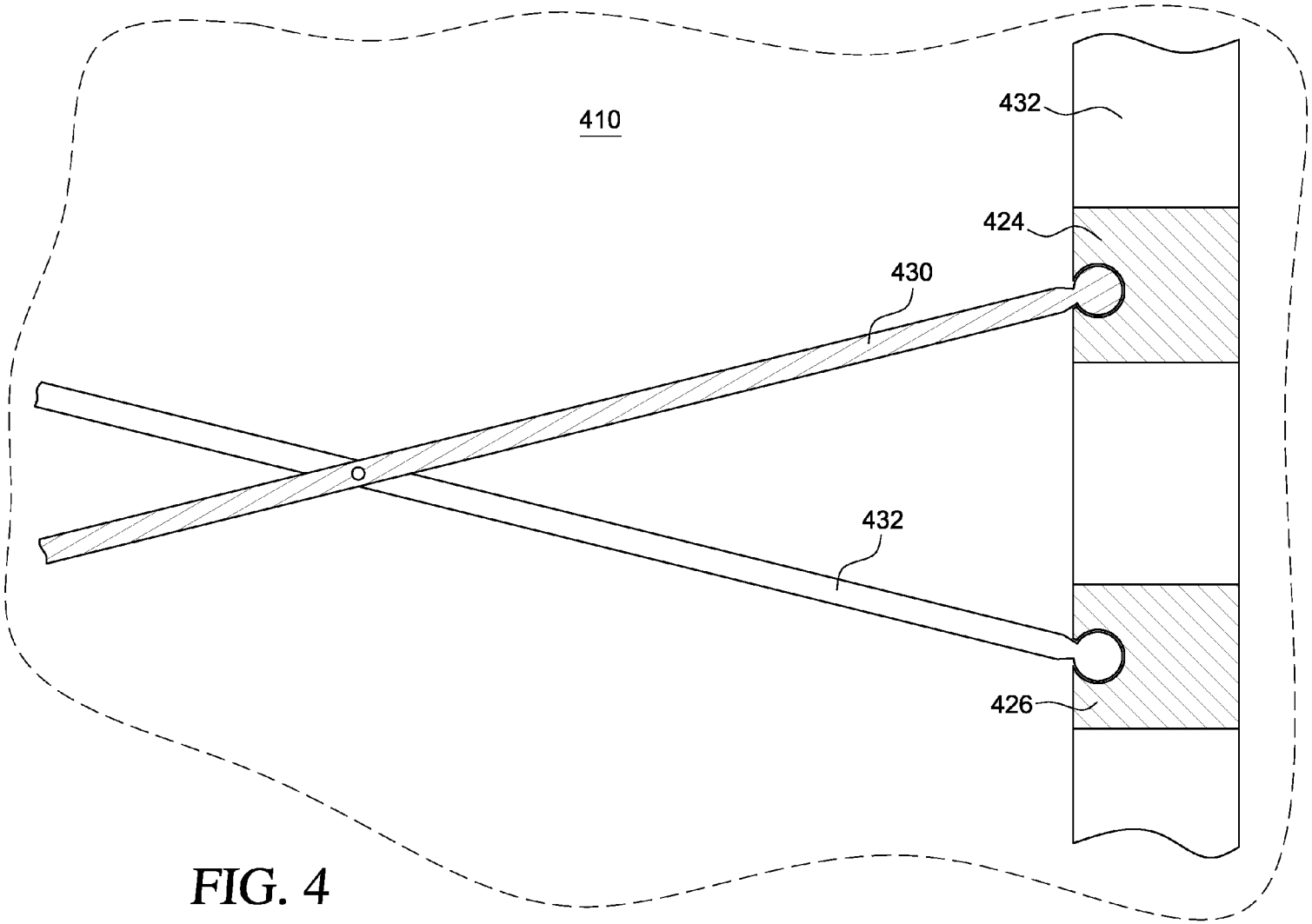
FIG. 4 is a top partial cutaway view of a trestle table according to an embodiment of the invention.
Figure 5:
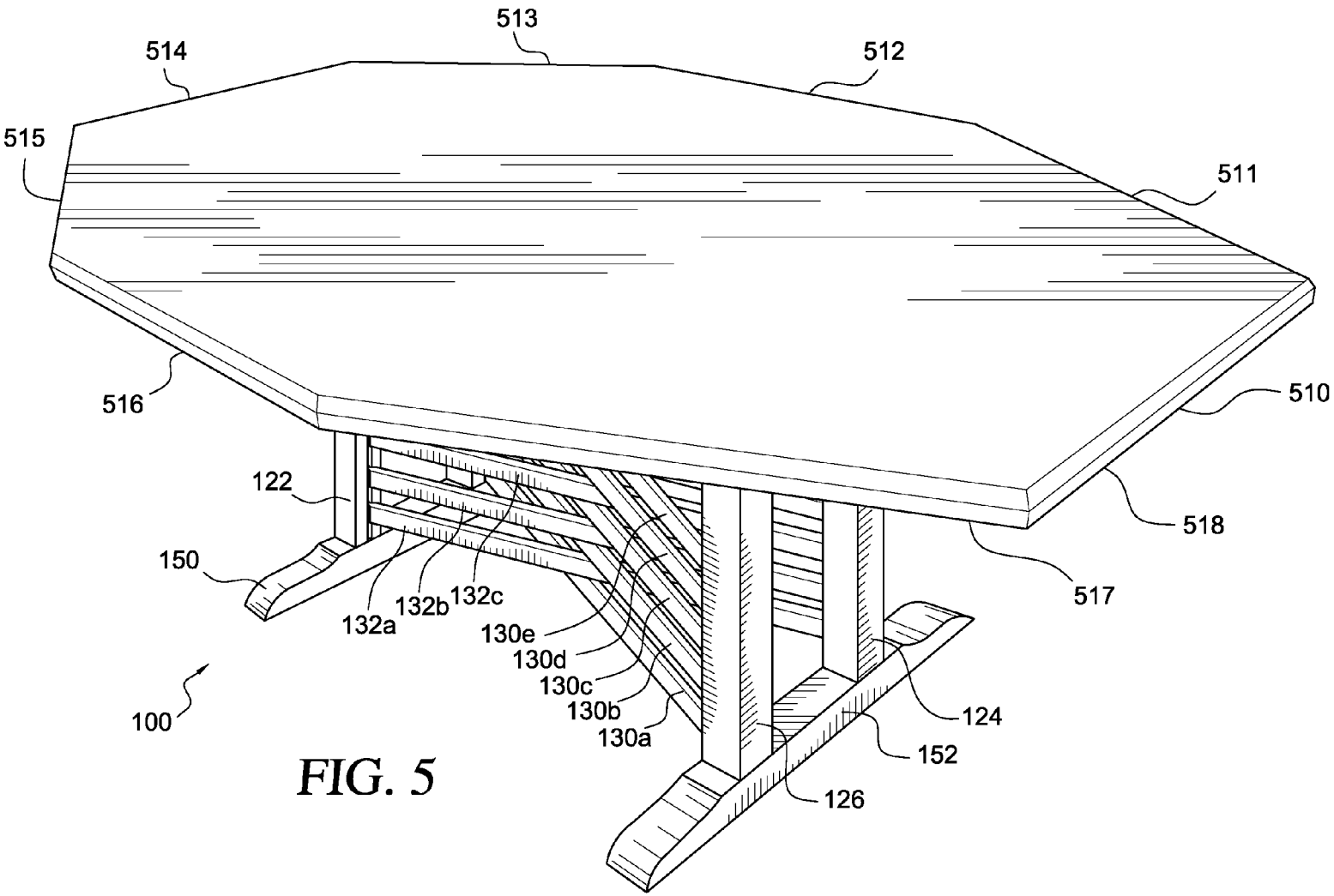
FIG. 5 is a front perspective view of a trestle table according to an embodiment of the invention.

FIG. 4 illustrates a top view of a collapsible table 400 according to an embodiment of the invention. The collapsible table 400 includes a table top 410 and stretchers 430 and 432. The stretchers 430 and 432 are not permanently affixed to the legs, but are machined into a dow or round end that slideably engage and are removably affixed to the legs. More specifically, legs 420, 422 (not shown) and 424, 426 are machined with a circular channel allowing the stretchers 430 and 432 to drop into the legs 420-426 from the top (e.g., in an alternating sequence). Round dows of the same height as the stretchers 430 and 432 assist in both the installation of the spacing and the aesthetic appearance of the design. An advantage of the barrel end styled stretchers is that the same legs can be used for tables of varying length, thus requiring only stretchers having different lengths.

The collapsible table 400 allows for carton type storage and transportation. In the event that it is not necessary or desirable to have the same legs 420-426 used for tables of varying lengths, the legs 420-426 can be machined with a standard dove tail slot with corresponding dove tails cut in the stretchers 430 and 432. This reduces the level and complexity of machining in the legs 420-426 and stretchers 430 and 432.

Figure 6:
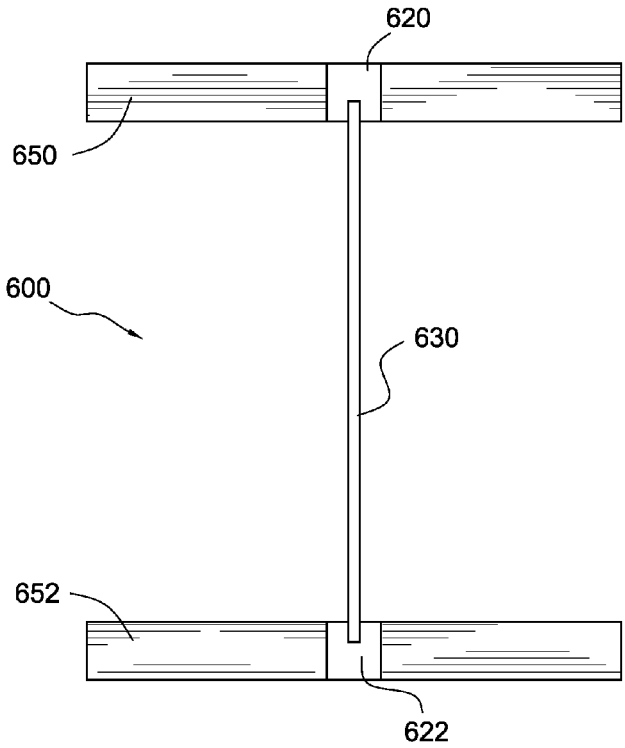
FIG. 6 is a bottom cross-sectional view of a trestle table according to an embodiment of the invention.
Figure 7:
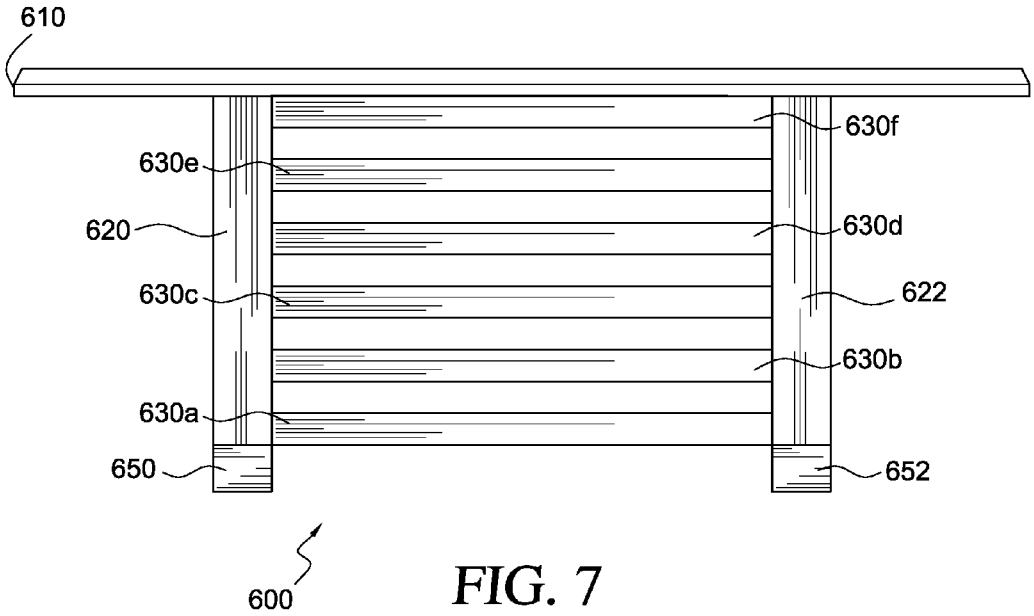
FIG. 7 is a front view of a trestle table according to an embodiment of the invention.

In another embodiment of the invention, a table 600 only includes a single set of stretchers 630. As illustrated in FIGS. 6-7, stretchers 630*a*-630*f* are connected to legs 620 and 622. The tops of the legs 620 and 622 are connected to a table top 610; and, the bottoms of the legs 620 and 622 are connected to leg supports 650 and 652, respectively. While not a strong as the diagonal cross-weave, the single pair of legs 620, 622 with a single row of stretchers 630 are simpler to construct and cheaper to build.

The basket weave trestle table provides the constructional rigidity of a solid base, which can be used as the full structural component of the table without requiring structural integration of the table top. This allows for a table top design with a full range of aesthetic choices. The table top is therefore not an integral part of the necessary structure. Glass and other table tops could be used and placed upon the underlying basket weave trestle structure.

Although specific example embodiments have been illustrated and described herein, those of ordinary skill in the art appreciate that other variations, aspects, or embodiments may be contemplated, and/or practiced without departing from the scope or the spirit of the appended claims.

The invention claimed is:

1. A support trestle comprising:

at least a first, second, and third generally vertically disposed support elements;

a first set of stretchers connected to at least two of said first, second, and third generally vertically disposed support elements, said first set of stretchers comprising a top first stretcher, at least one middle first stretcher, and a bottom first stretcher; and a second set of stretchers connected to at least two of said first, second, and third generally vertically disposed support elements, said second set of stretchers comprising a top second stretcher, at least one middle second stretcher, and a bottom second stretcher, wherein said top second stretcher, said at least one middle second stretcher, and said bottom second stretcher interlace and respectively overlie said top first stretcher, said at least one middle first stretcher, and said bottom first stretcher, such that a first angle, a second angle, a third angle, and a fourth angle are formed between said first set of stretchers and said second set of stretchers, wherein said first and said third angles are each greater than 44 degrees, wherein said first and said third angles are each less than 90 degrees, wherein said second and said fourth angles are each greater than 100 degrees, and wherein said second and said fourth angles are each less than 179 degrees, wherein the at least one generally vertically disposed support element that said second set of stretchers are connected to is different from the generally vertically disposed support elements that said first set of stretchers are connected to, and wherein said first set of stretchers criss-cross said second set of stretchers at a point along a length of said second set of stretchers.

2. The support trestle according to claim 1, wherein said first and second sets of stretchers are generally horizontally disposed relative to said first, second, and third generally vertically disposed support elements.

3. The support trestle according to claim 1, further comprising at least one fourth generally vertically disposed support element, wherein said first set of stretchers are connected to said first and third generally vertically disposed support elements, and wherein said second set of stretchers are connected to said second and fourth generally vertically disposed support elements.

4. The support trestle according to claim 1, wherein said first set of stretchers each comprise a first length, and wherein said second set of stretchers each comprise a second length.

5. The support trestle according to claim 4, wherein said first length is equal to said second length, and wherein said first length is greater than a height of each of said first, second, and third generally vertically disposed support elements.

6. The support trestle according to claim 1, further comprising a surface contacting top portions of said first, second, and third generally vertically disposed support elements.

7. The support trestle according to claim 1, further comprising a rod disposed through said first and second set of stretchers at said point along the length of said second set of stretchers.

8. The support trestle according to claim 1, wherein said bottom second stretcher is above said bottom first stretcher;

said at least one middle first stretcher is above said bottom second stretcher;

said at least one middle second stretcher is above said at least one middle first stretcher;

said top first stretcher is above said at least one middle second stretcher, and said top second stretcher is above said top first stretcher.

9. The support trestle according to claim 1, wherein at least one second stretcher of said second set of stretchers is positioned between each overlying pair of first stretchers of said first set of stretchers.

10. The support trestle according to claim 1, wherein at least one first stretcher of said first set of stretchers is positioned between each overlying pair of second stretchers of said second set of stretchers.

11. The support trestle according to claim 1, wherein said first set of stretchers include at least one upper first stretcher and at least one lower first stretcher, wherein at least one second stretcher of said second set of stretchers is positioned between each said upper first stretcher and each said lower first stretcher.

12. The support trestle according to claim 1, wherein said first and second set of stretchers each comprise first mating elements disposed on opposite ends thereof, and wherein said first, second, and third generally vertically disposed support elements each comprise a complementary second mating element for receiving said first mating elements therein.

13. The support trestle according to claim 12, wherein said second mating element comprises a channel.

14. The support trestle according to claim 13, wherein said first mating elements each comprise a rounded configuration, and wherein said channel comprises a circular cross-section.

15. A device comprising:

a surface comprising a first end, a second end, a third end, and a fourth end;

first and second vertical members proximate said first end of said surface;

third and fourth vertical members proximate said second end of said surface, wherein said first and third vertical members are proximate said third end of said surface, and wherein said second and fourth vertical members are proximate said fourth end of said surface;

a plurality of first horizontal members, each of said first horizontal members comprising a first end and a second end, wherein said first ends of said first horizontal members are connected to said first vertical member, wherein said second ends of said first horizontal members are connected to said fourth vertical member, and wherein said first horizontal members each comprise a first length, said first length is greater than a height of said first vertical member and a height of said fourth vertical member; and a plurality of second horizontal members, each of said second horizontal members comprising a first end and a second end, wherein said first ends of said second horizontal members are connected to said second vertical member, wherein said second ends of said second horizontal members are connected to said third vertical member, wherein said second horizontal members each comprise a second length, said second length is greater than a height of said second vertical member and a height of said third vertical member, wherein said first horizontal members criss-cross said second horizontal members at a point along a length of said second horizontal members such that a first angle, a second angle, a third angle, and a fourth angle are formed between said first horizontal members and said second horizontal members, wherein said first and said third angles are each less than 80 degrees, and wherein said second and said fourth angles are each greater than 100 degrees.

16. The device according to claim 15, wherein said first horizontal members comprise first intersection points, wherein said second horizontal members comprise second intersection points, wherein said first intersection points of said first horizontal members are at least one of directly above and directly below said second intersection points of said second horizontal members.

17. The device according to claim 15, wherein said first horizontal members include a bottom first horizontal member, at least one middle first horizontal member, and a top first horizontal member, said second horizontal members include a bottom second horizontal member, at least one middle second horizontal member, and a top second horizontal member, said bottom second horizontal member is above said bottom first horizontal member;

said at least one middle first horizontal member is above said bottom second horizontal member;

said at least one middle second horizontal member is above said at least one middle first horizontal member;

said top first horizontal member is above said at least one middle second horizontal member, and said top second horizontal member is above said top first horizontal member.

18. The device according to claim 15, wherein said first horizontal members include at least one upper first horizontal member and at least one lower first horizontal member, wherein at least one second horizontal member is positioned between each said upper first horizontal member and each said lower first horizontal member.

19. A device comprising:

at least a first, second, third, and fourth generally vertically disposed support elements;

a first set of horizontal members connected to at least two of said first, second, third, and fourth generally vertically disposed support elements, said first set of horizontal members comprising a top first horizontal member, at least one middle first horizontal member, and a bottom first horizontal member; and a second set of horizontal members connected to at least two of said first, second, third, and fourth generally vertically disposed support elements, said second set of horizontal members comprising a top second horizontal member, at least one middle second horizontal member, and a bottom second horizontal member, wherein said second set of horizontal members are stacked on said first set of horizontal members such that said bottom second horizontal members contacts said bottom first horizontal members, said at least one middle first horizontal members contacts said bottom second horizontal members, said at least one middle second horizontal members contacts said at least one middle first horizontal members, said top first horizontal members contacts said at least one middle second horizontal members, and said top second horizontal members contacts said top first horizontal members, wherein the generally vertically disposed support elements that said second set of horizontal members are connected to are different from the generally vertically disposed support elements that said first set of horizontal members are connected to, wherein said first set of horizontal members criss-cross said second set of horizontal members at a point along a length of said second set of horizontal members such that a first angle, a second angle, a third angle, and a fourth angle are formed between said first horizontal members and said second horizontal members, wherein said first and said third angles are each acute angles, and wherein said second and said fourth angles are each obtuse angles.

20. The device according to claim 19, wherein said bottom second horizontal member is above said bottom first horizontal member;

said at least one middle first horizontal member is above said bottom second horizontal member;

said at least one middle second horizontal member is above said at least one middle first horizontal member;

said top first horizontal member is above said at least one middle second horizontal member, and said top second horizontal member is above said top first horizontal member.

* * * * *